United States Patent [19]

Miller

[11] Patent Number: 4,591,817

[45] Date of Patent: May 27, 1986

[54] MAGNETIC SOCKET HOLDER

[75] Inventor: Merrill R. Miller, Clarinda, Iowa

[73] Assignee: Lisle Corporation, Clarinda, Iowa

[21] Appl. No.: 705,551

[22] Filed: Feb. 26, 1985

Related U.S. Application Data

[63] Continuation-in-part of Ser. No. 584,120, Mar. 28, 1984, which is a continuation-in-part of Ser. No. 464,407, Feb. 7, 1983, Pat. No. 4,451,810.

[51] Int. Cl.[4] ..... H01F 7/20

[52] U.S. Cl. ..... 335/285; 335/302

[58] Field of Search ..... 335/285, 286, 295, 302, 335/303, 306

[56] References Cited

U.S. PATENT DOCUMENTS

| | | | |
|---|---|---|---|
| 2,888,289 | 5/1959 | Scott et al. | 335/285 X |
| 3,122,684 | 2/1964 | Genin | 335/285 |
| 3,189,981 | 6/1965 | Genin et al. | 335/285 X |
| 3,821,676 | 6/1974 | Carr | 335/285 |

*Primary Examiner*—George Harris

*Attorney, Agent, or Firm*—Allegretti, Newitt, Witcoff & McAndrews, Ltd.

[57] ABSTRACT

An improved magnetic socket holder includes an elastic, magnetized material between a pair of soft iron plates. The assembly is held together by an extruded non-magnetic body.

3 Claims, 7 Drawing Figures

MAGNETIC SOCKET HOLDER

CROSS REFERENCE TO RELATED APPLICATIONS

This is a continuation-in-part application of Ser. No. 584,120, filed Mar. 28, 1984, which is, in turn, a continuation-in-part of application Ser. No. 464,407, filed Feb. 7, 1983, now U.S. Pat. No. 4,451,810.

BACKGROUND OF THE INVENTION

This invention relates to an improved magnetic socket holder and, more particularly, to a magnetic socket holder of simplified construction similar in operation to previously known magnetic tool holders, but having a construction specifically designed for holding sockets.

Various prior art tool holders are comprised of a pair of parallel metal plates with a series of ceramic magnets glued therebetween. A pair of metal holders welded to the back edge of the plates support the device on a wall, a cabinet or the like. The brackets maintain the plates positioned with respect to one another in a separated and rigid condition. Preferably a layer of tape is fitted over the edge of the ceramic magnets which provides enhanced visibility for the tool holder. This assembly is quite useful and effective for support or holding of tools by means of magnetism.

Heretofore sockets associated with a wrench have been stored on clips mounted on a board or in tool box compartments. While such socket storage constructions are quite useful for their purpose, it is often difficult to remove a socket from a clip or from a compartment in a tool box. Thus, though the aforesaid constructions are very useful, complications result particularly when it is desired to use such arrangements for socket storage. The present invention thus contemplates an improved combination of elements which eliminate some of the difficulties associated with the prior art socket holders particularly difficulties in assembly and difficulties of access and removal of sockets from the holder. This is accomplished by utlizing a novel variety of magnetic tool holder for storage of sockets.

SUMMARY OF THE INVENTION

Briefly, the present invention comprises an improved magnetic socket holder fabricated from a single magnetic bar fashioned from an elastomeric material sandwiched between a pair of equally sized, spaced metal plates which serve as pole pieces. The assembly is held together by an extruded or formed non-magnetic material which engages slits defined in the pole pieces. The bar is an elastomeric material such as nitrile rubber with impregnated magnetic material or powder retained therein. The pole pieces include projections which grip the elastomeric bar and thereby insure that the holder will remain assembled.

Thus it is an object of the present invention to provide an improved socket holder.

A further object of the present invention is to provide a socket holder which is easy to assemble and manufacture yet which provides improved access to sockets which are stored thereon.

Still another object of the invention is to provide an improved socket holder which may be used in numerous situations with tool boxes, for example, tool chests or in other environments.

Yet another object of the invention is to provide an improved socket holder which utilizes a magnetic bar held in position in the holder by means of compression of the various elements forming the holder. In this manner, welding, gluing and other fabrication techniques are not necessary.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 5:
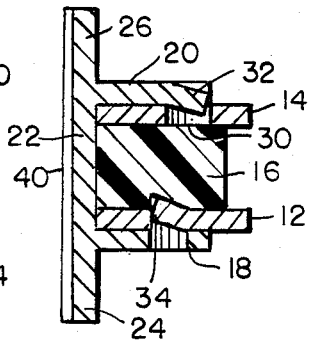
FIG. 5 is a partial cross sectional view of the holder of FIG. 1 taken substantially along the line 5—5.

The improved socket holder of the present invention is comprised of a body 10 which retains opposed plates 12 and 14 about a bar 16. The body 10 is preferably fabricated by an extrusion process, for example, from a non-magnetic material such as aluminum. The plates 12 and 14 define magnetizable pole pieces and are preferably fabricated from a soft iron material, for example. The bar 16 is a flexible or elastic material in the preferred embodiment and is magnetic with the magnetic field directed between the pole pieces 12 and 14 as illustrated in FIG. 5. For example, the bar may be fabricated from a rubber or a synthetic rubber such as nitrile rubber impregnated with magnetic powder such as barrium ferrite. Typical flexible magnetic elements are available from 3M Company under the tradename "Plastiform", and Electrodyne Company under the tradename "Plastalloy", and B. F. Goodrich Company under the tradename "Koroseal".

Referring to the remaining figures, the body 10 is comprised of opposed generally planar logitudinal sides 18, 20 spaced from one another by a back 22. The back 22 is a generally planar member having planar side extensions 24 and 26. The sides 18 and 20 and back 22 form a rectangular tray or trough for receipt of the plates 12 and 14 as well as bar 16.

Figure 1:
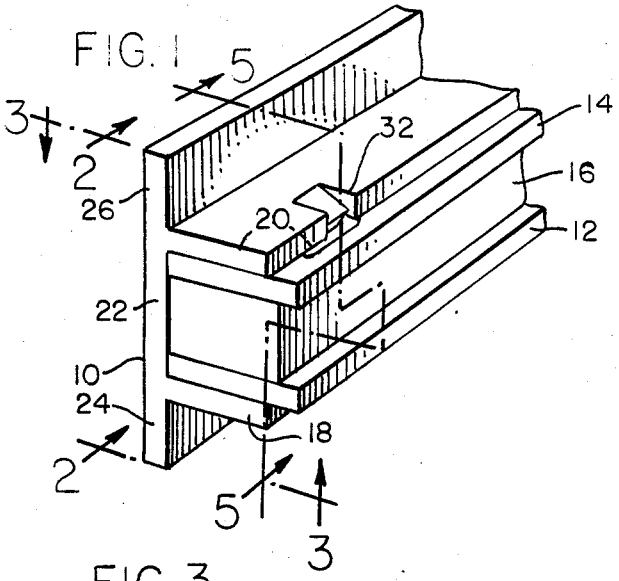
FIG. 1 is a perspective view of the improved socket holder of the invention.
Figure 2:
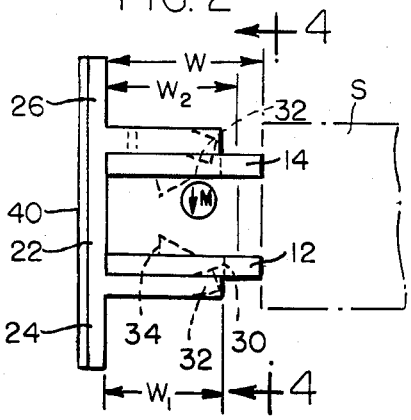
FIG. 2 is an end view of the socket holder of FIG. 1.
Figure 3:
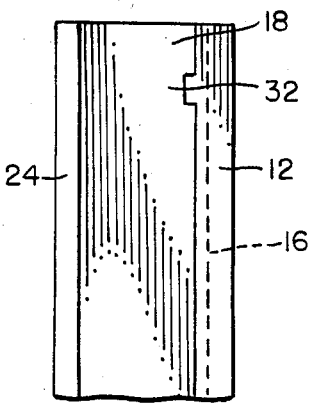
FIG. 3 is a top plan view of the socket holder of FIG. 1.
Figure 4:
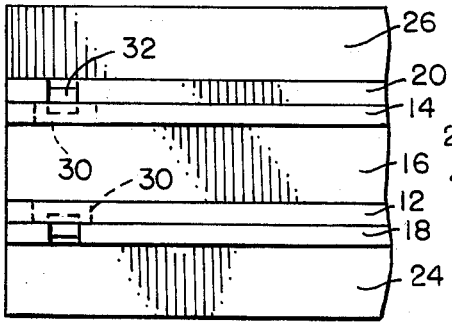
FIG. 4 is a side elevation view of the socket holder of FIG. 1.

Positioned within the trough defined by the sides 18, 20 and back 22 immediately adjacent each of the sides 18, 20 are plates 12 and 14, respectively. Each plate 12 and 14 is comprised of a magnetizable material such as soft iron. The length dimension of the plates 12 and 14 is substantially equal to the length of the body 10. The width of the plate 12 represented by the dimension w in FIG. 2 is greater than the width $w_1$ of the sides 18 and 20. The plates 12 and 14 are each fabricated in substantially the same manner. For example, plate 14 includes at least one longitudinal slit 30 aligned substantially with the top edge of side 18 when the plate 12 is inserted into the trough defined by the sides 18 and 20. The slit 30 may extend partially or totally through the plate 14. However, it is important that the slit 30 be in opposed relation with the side, for example, side 18. This results since the side 18 is formed or deformed into the slit 30 to define a locking tab 32 as shown in FIG. 5. Tab 32 retains the plate 14 in position.

Figure 6:
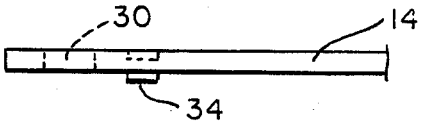
FIG. 6 is an enlarged top plan view of the pole piece of the improved socket holder of the present invention.
Figure 7:
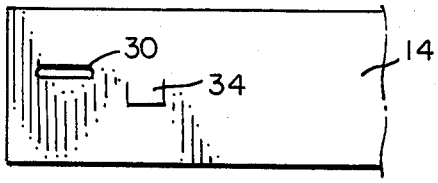
FIG. 7 is a side elevation view of the pole piece of FIG. 6.

Plate 12 which is the mirror image of plate 14 also includes an inwardly extending projection 34 as shown in FIGS. 5–7 which projects toward back 22. The inwardly extending projection 34 may be formed by stamping plate 12. The projection 34 constitutes means for gripping and deforming the bar 16. Since the bar 16 is elastically deformable, the projection 34 will grip into the bar 16 when the socket holder is in the assembled condition to thereby retain the assembled parts together. That is, the plates 12 and 14 as well as bar 16 are inserted between the sides 18 and 20 during assembly. The sides 18 and 20 are then deformed to form tabs, as at 32, to engage appropriate corresponding slits, as at slit 30, in bar 12. This holds the projections 34 in the bar 16 and retains the entire assembly in a substantially locked together, fixed condition.

As another feature of the invention, the bar 16 has a width $w_2$ in FIG. 5 which is less than the width w of the plates 12 and 14. Preferably the width, $w_2$, is less than the width, w, so that an air gap will be defined at the top of bar 16 between the plates 12 and 14 even when a socket, socket S in FIG. 5, is positioned across the plates 12 and 14. Thus, since the magnetic field (M) of the bar 16 is directed from one plate 12 to the other plate 14 through bar 16, a magnetic circuit will be defined when a socket S is placed against plates 12 and 14. In other words, one of the plates 12 will be, for example, a North Pole of the magnetic socket holder, and the other plate 14 will be the South Pole. Placement of the socket S across the poles 12 and 14 will complete a magnetic circuit and hold the socket, S, tightly in position. In this manner, a more efficient, more effective socket holder is provided.

The fact that the width $w_2$ of the bar 16 is less than the width w of the plates 12 and 14 permits such a magnetic circuit to be formed. This enhances the efficiency and operability of the device. Since the extruded body 10 is formed from a non-magnetic material, for example, aluminum, the entire assembly defines a magnetic socket holder wherein the magnetic field is localized in the plates 12 and 14 and bar 16.

In a preferred embodiment of the invention, the back 22 and extensions 24 and 26 are provided with an adhesive backing 40. This backing 40 permits attachment of the socket holder to a tool bench or in a tool box, for example.

The length dimension of the socket holder may vary according to desired number of socket members which are to be stored on the socket holder. The width, likewise, may be varied depending upon the magnetic strength of the bar 16. As previously mentioned, it is most desired to have the width $w_2$ of the bar 16 less than the width w of the plates 12 and 14. The thickness of the bar 16 is preferably equal to or very slightly greater than the distance between the spaced plates 14 so that the bar 16 will be held slightly in compression between plates 12, 14 and sides 18 and 20. Nonetheless, it is desirable to provide a slit 30 so that the sides, for example side 18, may be deformed therein. It is also desired to maintain a tab, protrusion or projection 34 from the bar 12 so that the bar 16 may be held in position.

With the present invention, sockets of various size may be stored on the holder. This is in contrast to a clip arrangement wherein clip size must be matched to socket size. Thus, the present socket holder is universal in use. The socket is merely bridged between plates 12, 14. To remove the socket, it is simply rocked from side to side to break the magnetic circuit.

While there has been set forth a preferred embodiment of the invention, it is to be understood that the invention is to be limited only by the following claims and their equivalents.

What is claimed is:

1. An improved magnetic socket holder comprising, in combination:

a pair of equal sized, generally rectangular, opposed metallic plates of a magnetizable material forming opposed, spaced pole pieces, each plate including at least one slit in an outside planar surface;

a single magnetic bar having a width dimension no greater than the width of the plates, said bar interposed between the plates and comprised of a flexible material impregnated with a magnetic powder material, the magnetic field of the bar extending from one plate toward the other plate, said bar having a thickness generally corresponding to the distance between the opposed, spaced plates, each of said plates also including at least one projection into the bar to retain the bar in position between the plates; and a unitary extruded, non-magnetic body for rigidly retaining the plates and bar, said body including opposed parallel, planar spaced sides joined together by a transverse, planar back to form a U shaped cross section slot for receipt and retention of the plates and bar, each one of the planar sides respectively abutted against a pole piece plate and deformed in part into the slit formed in the pole piece to thereby retain the pole piece plates and bar whereby the plates define separate poles for the socket holder.

2. The improvement of claim 1 including an adhesive backing on the back of the body.

3. The improvement of claim 1 including outward extensions from the back defining a platform to support the back.

* * * * *